US009424859B2

(12) United States Patent
Campbell et al.

(10) Patent No.: US 9,424,859 B2
(45) Date of Patent: Aug. 23, 2016

(54) SYSTEM TO CONTROL AUDIO EFFECT PARAMETERS OF VOCAL SIGNALS

(71) Applicant: Harman International Industries Canada Ltd., Victoria (CA)

(72) Inventors: Norm Campbell, Delta (CA); Peter Lupini, Victoria (CA); Glen Rutledge, Brentwood Bay (CA)

(73) Assignee: Harman International Industries Canada Ltd., Victoria, BC (CA)

( * ) Notice: Subject to any disclaimer, the term of this patent is extended or adjusted under 35 U.S.C. 154(b) by 581 days.

(21) Appl. No.: 13/683,829

(22) Filed: Nov. 21, 2012

(65) Prior Publication Data

US 2014/0142927 A1 May 22, 2014

(51) Int. Cl.

| | |
|---|---|
| ***G10L 21/00*** | (2013.01) |
| ***G10H 1/00*** | (2006.01) |
| ***H04R 3/00*** | (2006.01) |

(52) U.S. Cl.

CPC ..... *G10L 21/00* (2013.01); *G10H 1/0091* (2013.01); *H04R 3/005* (2013.01); *G10H 2210/315* (2013.01); *G10H 2220/211* (2013.01)

(58) Field of Classification Search

CPC ..... G10L 2021/02166; G10L 21/0208; G10L 2021/02087; G10L 21/0272; H04R 3/005; H04R 1/40; H04R 25/40; G10H 1/10; G10H 1/366

USPC ..... 704/201, 500, 233, 228, 226; 84/669, 84/613, 610, 604, 600; 715/716; 709/206; 381/94.7, 92, 71.1, 313, 17, 13

See application file for complete search history.

(56) References Cited

U.S. PATENT DOCUMENTS

| | | | | | |
|---|---|---|---|---|---|
| 4,644,400 | A | * | 2/1987 | Kouyama | H04N 5/60 348/512 |
| 5,166,465 | A | * | 11/1992 | Jeon | G10H 1/36 84/637 |
| 5,253,298 | A | * | 10/1993 | Parker | H04H 20/49 381/13 |
| 5,773,744 | A | * | 6/1998 | Nagata | G10H 1/366 434/307 A |
| 6,069,961 | A | | 5/2000 | Nakazawa | |

(Continued)

OTHER PUBLICATIONS

TC-Helicon—VoiceLive Play GTX; http://www.tc-helicon.com/products/voicelive-play-gtx/; published on or before Jan. 14, 2012, pp. 1-8.

(Continued)

*Primary Examiner* — Michael Colucci
(74) *Attorney, Agent, or Firm* — Brooks Kushman P.C.

(57) ABSTRACT

A vocal effect processing system may include an effect modification module configured to selectively and dynamically apply effects to an input audio signal in accordance with a degree of likelihood that the input audio signal includes a vocal signal and/or based on a proximate location of a source of vocal audio with respect to a vocal microphone. Determination of the degree of likelihood that the input audio signal includes a vocal signal and/or the proximate location may be based on processing of the input audio signal or a plurality of input audio signals. Determination of the proximate location may alternatively, or in addition, be estimated based on a proximity sensor. The effect modification module may dynamically and selectively adjust the effects in response to changes in the degree of likelihood that the vocal signal is included in the input audio signal and/or changes in the estimated proximate location.

22 Claims, 7 Drawing Sheets

(56) References Cited

U.S. PATENT DOCUMENTS

| | | | | |
|---|---|---|---|---|
| 8,168,877 | B1 * | 5/2012 | Rutledge | G10H 1/38 84/613 |
| 8,204,253 | B1 * | 6/2012 | Solbach | H04R 3/005 381/94.7 |
| 8,520,857 | B2 * | 8/2013 | Fukui | G04S 1/005 381/17 |
| 8,798,289 | B1 * | 8/2014 | Every | G06F 1/325 381/57 |
| 8,878,708 | B1 * | 11/2014 | Sanders | H03M 1/70 341/139 |
| 2002/0090094 | A1 | 7/2002 | Amir et al. | |
| 2004/0131201 | A1 | 7/2004 | Hundal et al. | |
| 2006/0083392 | A1 | 4/2006 | Akino | |
| 2007/0017346 | A1 * | 1/2007 | Masuda | G10H 1/053 84/600 |
| 2007/0019066 | A1 * | 1/2007 | Cutler | H04N 5/23238 348/14.08 |
| 2007/0064925 | A1 * | 3/2007 | Suzuki | H04R 3/02 379/420.01 |
| 2007/0139878 | A1 * | 6/2007 | Giffin | B60R 11/02 369/99 |
| 2007/0244698 | A1 * | 10/2007 | Dugger | G10L 21/02 704/228 |
| 2007/0291876 | A1 * | 12/2007 | Shridhar | H04H 40/18 375/316 |
| 2008/0034946 | A1 * | 2/2008 | Aimi | G10H 3/146 84/604 |
| 2008/0056517 | A1 * | 3/2008 | Algazi | H04S 7/304 381/310 |
| 2008/0170717 | A1 | 7/2008 | Liu et al. | |
| 2009/0015658 | A1 * | 1/2009 | Enstad | H04N 5/232 348/14.08 |
| 2009/0089054 | A1 | 4/2009 | Wang et al. | |
| 2009/0147967 | A1 * | 6/2009 | Ishibashi | H04R 1/40 381/92 |
| 2009/0299742 | A1 * | 12/2009 | Toman | G10L 21/0272 704/233 |
| 2009/0326959 | A1 * | 12/2009 | Herre | H04S 5/00 704/500 |
| 2010/0020980 | A1 * | 1/2010 | Kim | G10K 11/175 381/71.1 |
| 2010/0103776 | A1 * | 4/2010 | Chan | G01S 11/14 367/119 |
| 2010/0158290 | A1 * | 6/2010 | Puder | H04R 25/43 381/313 |
| 2011/0191432 | A1 * | 8/2011 | Layson, Jr. | G06Q 30/02 709/206 |
| 2011/0257967 | A1 * | 10/2011 | Every | G10L 21/0208 704/226 |
| 2012/0008802 | A1 | 1/2012 | Felber | |
| 2013/0132837 | A1 * | 5/2013 | Mead | G06Q 10/10 715/716 |
| 2014/0325357 | A1 * | 10/2014 | Sant | G06F 17/30053 715/716 |

OTHER PUBLICATIONS

TC-Helicon—VoiceLive Play; http://www.tc-helicon.com/products/voicelive-play/; published on or before Jan. 14, 2012, pp. 1-8.

Communications Systems—LBB 1968/00 Plena Feedback Suppressor; Installation and Operation Manual, 26 pgs. Nov. 2003.

Ramsey—"Vox" Voice Activated Switch; Kit No. VS1; 14 pages. 1994.

Murphy-Chutorian, Erik and Manubhai Trivedi, Mohan; *IEEE Transaction on Pattern Analysis and Machine Intelligence*, "Head Pose Estimation in Computer Vision: A Survey", vol. 31, No. 4, Apr. 2009, pp. 607-626.

Extended European Search Report for corresponding Application No. 13192872.3, mailed Feb. 21, 2014, 8 pages.

European Office Action for corresponding Application No. 13 192 8723, mailed Nov. 30, 2015, 7 pages.

* cited by examiner

SYSTEM TO CONTROL AUDIO EFFECT PARAMETERS OF VOCAL SIGNALS

TECHNICAL FIELD

This disclosure pertains to vocal effect processors, and more specifically to a system to control audio effect parameters of vocal signals.

RELATED ART

A vocal effect processor is a device that is capable of modifying an input vocal signal in order to change the sound of a voice. The vocal signal may typically be modified by, for example, adding reverberation, creating distortion, pitch shifting, and band-limiting. Non real-time vocal processors generally operate on pre-recorded signals that are file-based and produce file-based output. Real-time vocal processors can operate with fast processing using minimal look-ahead such that the processed output voices are produced with very short delay, such as less than 500 ms, making it practical to use them during a live performance. A vocal processor can have a microphone connected to an input of the processor. The vocal processor may also include other inputs, such as an instrument signal, that can be used to determine how the input vocal signal may be modified. In some vocal harmony processors, for example, a guitar signal is used to determine the most musically pleasing pitch shift amount in order to generate vocal harmonies that sound musically correct with respect to the input vocal melody.

SUMMARY

A system to selectively modify or control audio effect parameters of vocal signals includes an effect modification module. One or more audio signals may be received and processed by the effect modification module to selectively apply effects to a vocal signal included in the audio signal. Determination of when to apply effects, what type of effects to apply, and to what extent to apply effects to the audio signal may be determined by the system.

In one example, the system may determine a likelihood that a respective one of the audio signals includes a vocal signal. Based on the degree of likelihood, or probability, that a respective audio signal includes a vocal signal, one or more effects may be dynamically selected and applied to the audio signal. In addition, in this example one or more effects may be modified, selected, or removed, as the degree of likelihood varies.

In another example, the system may determine a proximity of a microphone to the source of a vocal signal, such as a singer or speaker. In this example, the system may select, apply, remove, and modify effects based on the relative proximity. The proximity may be determined based on parameters used to determine association of the vocal signal and the microphone. Thus, the proximity may be used, for example, to determine whether a singer or a speaker is intending to supply an audio signal to the microphone.

In a first example configuration, the effect modification module may include an estimate module (or unit), an effect determination module (or unit), and an application module (or unit). The estimate module may provide an indication of the degree of likelihood, or probability of the audio signal including a vocal signal. Based on this determination, the effect determination module may select one or more corresponding effects and/or modify one or more associated parameters of the effects. The application module may apply the selected effect(s), and/or adjust the parameters of the effect(s) to modify the audio signal.

In this first example configuration, the audio signals to which the effects are applied may be received by the effect modification module from one or more vocal audio microphones. The degree of likelihood or probability that the audio signals include a vocal signal may be determined based on analysis of the individual audio signals received from the vocal microphones, based on comparison of the audio signals received from different vocal audio microphones, and/or based on receipt of audio signals from the vocal microphones and non-vocal audio microphones. For example, an individual audio signal may be analyzed for characteristics indicative of the likelihood of the presence of an vocal signal, or two audio signals may be compared or correlated to determine the likelihood of at least one of the audio signals including a vocal signal.

In a second example configuration, the effect modification module may include a proximity determination module (or unit), a mic signals combination module (or unit), an effect determination module (or unit), and an application module (or unit). In this example, there may be one, or two or more vocal microphones. The location determination module may provide an indication of the relative proximate location of a source of vocal sound, such as a singer or talker, with respect to each of the one, or two or more, vocal microphones. Based on this determination, the combination module may combine the signals from the one, or two or more vocal microphones to form a activation based audio signal. In addition, the effect determination module may select one or more corresponding effects and/or modify one or more associated parameters of the effects based on the determination of the relative proximity of the source of the vocal sound. The application module may apply the selected effect(s), and/or adjust the parameters of the effect(s) to modify the audio signal.

In this example configuration, the system may determine an estimate of which microphone the singer is intending to activate (activation target) based on proximate location. The singer may intend to activate one particular microphone, or he/she may intend to activate two or more microphones in different relative amounts. One or more different methods for determining a proximate location and a corresponding activation target may be used, including estimating a distance between the singer and each input microphone. Thus, for example, an effect may be varied as a distance of a singer from a vocal microphone changes. As a result, for example, one or more corresponding effects may be selectively and dynamically varied as the singer moves toward and away from one microphone to adjust at least a first effect, and moves away and toward a second microphone to selectively and dynamically adjust at least a second effect.

Thus, the system may be used where the only audio input is a vocal microphone and effects may be selectively dynamically applied and/or modified. Alternatively, or in addition, the system may receive multiple audio inputs from different vocal microphones to selectively dynamically apply and modify effects to one or more of the audio signals. Alternatively, or additionally, the system may receive audio inputs from one or more vocal microphones and one or more non-vocal inputs, such as from a musical instrument to selectively dynamically apply and modify effects the audio inputs received from the one or more vocal microphones.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate correspondingly similar components, modules, units, and/or parts throughout the different views.

DETAILED DESCRIPTION

Figure 1:
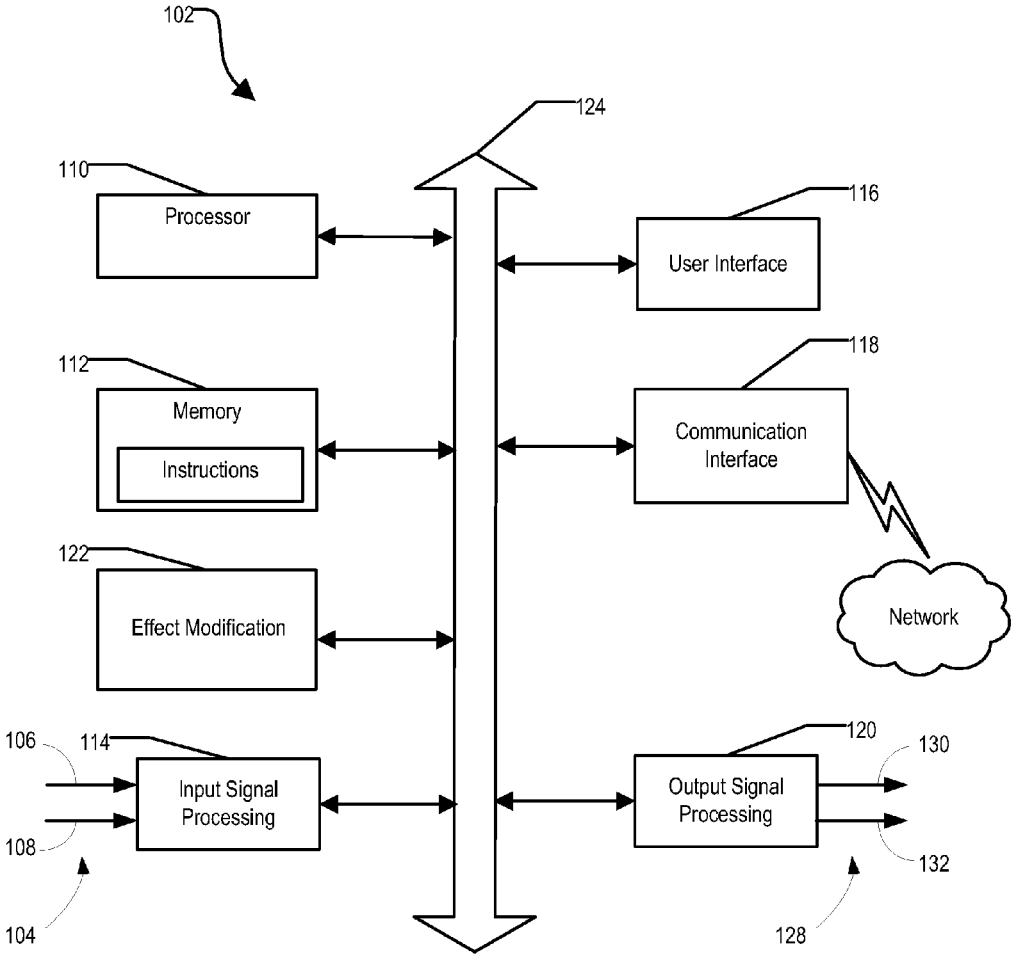
FIG. 1 is a block diagram of an example vocal processing system.

It is to be understood that the following description of examples of implementations are given only for the purpose of illustration and are not to be taken in a limiting sense. The partitioning of examples in function blocks, modules or units shown in the drawings is not to be construed as indicating that these function blocks, modules or units are necessarily implemented as physically separate units. Functional blocks, modules or units shown or described may be implemented as separate units, circuits, chips, functions, modules, or circuit elements. Alternatively, or in addition, one or more functional blocks or units may also be implemented in a common circuit, chip, circuit element or unit.

FIG. 1 is a block diagram of an example vocal effect processing system 102 that may receive one or more input signals on input signal channels 104. In one example, the input signals may include one or more audio signals that include one or more vocal microphone input signals on respective vocal microphone input channels 106, and one or more non-vocal audio signals, such as instrument input signals, for example a guitar signal, on respective instrument input channels 108. As described herein, a signal or audio signal generally refers to a time-varying electrical signal (voltage or current) corresponding to an audible sound to be presented to one or more listeners. Such signals can be produced with one or more audio transducers such as microphones, guitar pickups, or other devices. These signals can be processed by, for example, amplification or filtering or other techniques prior to delivery to audio output devices such as speakers or headphones. An "audio signal" refers to a signal whose source is any form of audible sound including music, background noise, and/or any other sound capable of being perceived. A "vocal signal" or "vocal audio signal" refers to a signal whose source is human voice, such as a human singing voice or speaking voice, and which may be included in an audio signal. As used herein, the term "signal" or "audio signal" is used to interchangeably describe both an electrical signal and an audible sound signal propagated as a sound wave, unless otherwise indicated. Further, a "vocal microphone," as used herein, is a microphone configured and used for receipt of a human voice either speaking or singing in the form of a vocal microphone signal, and a "non-vocal microphone," as used herein refers to a microphone configured and used for other than receipt of a human voice, such as configured for receipt of audible sound emitted by an instrument, or for receipt of background noise, or other such audible sound which provides a non-vocal microphone signal.

In FIG. 1, the vocal effect processing system 102 may include a processor 110, a memory module 112, an input signal processing module 114, a user interface module 116, a communication interface module 118, an output signal processing module 120 and an effect modification module 122. The terms "module" or "units" may be defined to include a plurality of executable modules or units, respectively, and may be used interchangeably. As described herein, the term "modules" or "units," are defined to include software, hardware or some combination thereof executable by the processor 110. Software modules or software units may include instructions stored in the memory module 112, or other memory device, that are executable by the processor 110 or other processor. Hardware modules or hardware units may include various devices, components, circuits, gates, circuit boards, and the like that are executable, directed, and/or controlled for performance by the processor 110.

The processor 110 may be any form of device(s) or mechanism(s) capable of performing logic operations, such as a central processing unit (CPU), a graphics processing unit (GPU), and/or a digital signal processor (DSP), or some combination of different or the same processors. The processor 110 may be a component in a variety of systems. For example, the processor 110 may be part of a personal computer, a workstation or any other computing device. The processor 110 may include cooperative operation of one or more general processors, digital signal processors (DSPs), application specific integrated circuits (ASICs), field programmable gate arrays (FPGA), digital circuits, analog circuits, and/or combinations thereof, and/or other now known or later developed devices for analyzing and processing data. The processor 110 may implement a software program, such as code generated manually or programmed. The processor 110 may operate and control at least a portion of the vocal effect processing system 102.

The processor 110 may communicate with the modules via a communication path, such as a communication bus 124. The communication bus 124 may be hardwired, may be a network, and/or may be any number of buses capable of transporting data and commands. The modules and the processor may communicate with each other on the communication bus 124.

The memory module 112 may include a main memory, a static memory, and/or a dynamic memory. The memory 112 may include, but is not limited to computer readable storage media, or machine readable media, such as various types of non-transitory volatile and non-volatile storage media, which is not a signal propagated in a wire, including but not limited to random access memory, read-only memory, programmable read-only memory, electrically programmable read-only memory, electrically erasable read-only memory, flash memory, magnetic tape or disk, optical media and the like. In one example, the memory 112 includes a cache or random access memory for the processor 110. In addition or alternatively, the memory 112 may be separate from the processor 110, such as a separate cache memory of a processor, the system memory, or other memory. The memory 112 may also include (or be) an external storage device or database for storing data. Examples include a hard drive, compact disc ("CD"), digital video disc ("DVD"), memory card, memory stick, floppy disc, universal serial bus ("USB") memory device, or any other device operative to store data.

The memory 112 is operable to store instructions executable by the processor 110 and data. The functions, acts or tasks illustrated in the figures or described may be performed by the programmed processor 110 executing the instructions stored in the memory 112. The functions, acts or tasks may be independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

The input signal processing module 114 may receive and process the input signals on the input signal channels 104. The input signal processing module 114 may include analog-to-digital (A/D) converters, gain amplifiers, filters and/or any other signal processing mechanisms, devices and/or techniques. Input signals may be analog signals, digital signals, or some combination of analog and digital signals. Input signals that are vocal and instrument signals are typically analog audio signals that are directed to the A/D converters. Alternatively, or in addition, the input signals may be provided in digital format and the A/D converters may be bypassed.

The user interface module 116 may receive and process user commands, and provide indication of the operation of the vocal effect processing system 102. The user interface module 116 may include, for example, a display unit, such as a liquid crystal display (LCD), an organic light emitting diode (OLED), a flat panel display, a solid state display, a cathode ray tube (CRT), a projector, or other now known or later developed display device for outputting determined information. The display may be a touchscreen capable of also receiving user commands. The user interface module 116 may also include indicators such as meters, lights, audio, or any other sensory related indications of functionality. The user interface module 116 may also include at least one input device configured to allow a user to interact with any of the modules and/or the processor 110. The input device may be a keypad, a keyboard, or a cursor control device, such as a mouse, or a joystick, touch screen display, remote control, knobs, sliders, switches, buttons, or any other device operative to interact with the vocal effects processing system 102.

The network module 118 may provide an interface to a network. Voice, video, audio, images or any other data may be communicated by the network module 118 over the network. The network module 118 may include a communication port that may be a part of the processor 110 or may be a separate component. The communication port may be created in software or may be a physical connection in hardware. The connection with the network may be a physical connection, such as a wired Ethernet connection, or may be established wirelessly. The network may include wired networks, wireless networks, Ethernet AVB networks, or combinations thereof. The wireless network may be a cellular telephone network, an 802.11, 802.16, 802.20, 802.1Q or WiMax network. Further, the network may be a public network, such as the Internet, a private network, such as an intranet, or combinations thereof, and may utilize a variety of networking protocols now available or later developed including, but not limited to TCP/IP based networking protocols.

The output signal processing module 120 may generate output signals on output channels 128, such as left and right components on respective left and right channels 130 and 132. Digital-to-analog (D/A) converters, filters, gain amplifiers, equalizers, or any other signal processing devices and/or techniques may be included in the output signal processing module 120. The left and right channels 130 and 132 may be a stereo output signal containing a mix of an input vocal signal and one or more effects that may be applied to the input signal using the effect modification module 122. In some examples only a monophonic signal may be output, and in other examples, more than two signals may be output (for example a mix of the original and effected signals, as well as multiple signals with just the applied effects).

The effect modification module 122 may selectively apply one or more effects to a vocal signal included in the input signal 104. The effects such as reverberation, echo, pitch shifting, distortion, band-limiting, or any other modification may be selectively applied upon determination with the effect modification module 122 of the likelihood or probability that a vocal signal is present in the input signal. In other examples, any other effect that changes the characteristic(s) of an audio signal may be applied by the effect modification module 122.

The user interface of the vocal effect processing system 102 may allow the user to enable or disable one or more vocal effects currently being applied. This may be accomplished by, for example, a button, or by a footswitch when the system is designed for on-the-floor use. One possible issue with manually enabling and disabling the system occurs when a vocal signal is intermittent, such as when a singer is not singing (for example during an instrumental break in a song). During times when the vocal signal is absent, an ambient signal can be picked up by a vocal microphone and this input signal can be processed and amplified by the system. This can create a displeasing sound—one example being the sound of a strummed guitar being unintentionally modified by a vocal harmony processor. Of course, if the singer disables the system during the time when he/she is not singing, the problem can be eliminated, but often this is not practical. For example, sometimes breaks in the vocal input signal occur for relatively short times between musical phrases, and the singer would have to be constantly enabling and disabling the system, which would be very difficult for the singer and distracting for both the singer and the audience.

The vocal effect processing system 102 may include automated functionality to selectively process the input audio signal by selection of vocal effects. The effect modification module 122 may be used to automatically modify the parameters of one or more vocal effects as part of the selection. Each of the vocal effects may be independently and selectively controlled, or the vocal effects may be controlled in groups. Control of the vocal effects may involve turning on and off one or more effects and/or dynamically adjusting the effects parameters, by adjustments such as a gain, aggressiveness, strength, effect activation thresholds, and the like. In one example, automatic modification of the parameters may be based on a vocal likelihood score (VLS). Rather than simply turning off the processed input signal when the energy drops below a threshold, the effect modification module 122 may determine how likely it is that an input signal includes a vocal signal. For example, the effect modification module 122 may adjust the parameters of the vocal effect (such as effect strength) being applied to the audio signal to minimize the processing of unintended input audio, while at the same time minimizing abrupt changes to the effected output signal in response to changes in the likelihood that the audio signal includes a vocal signal.

Figure 2:
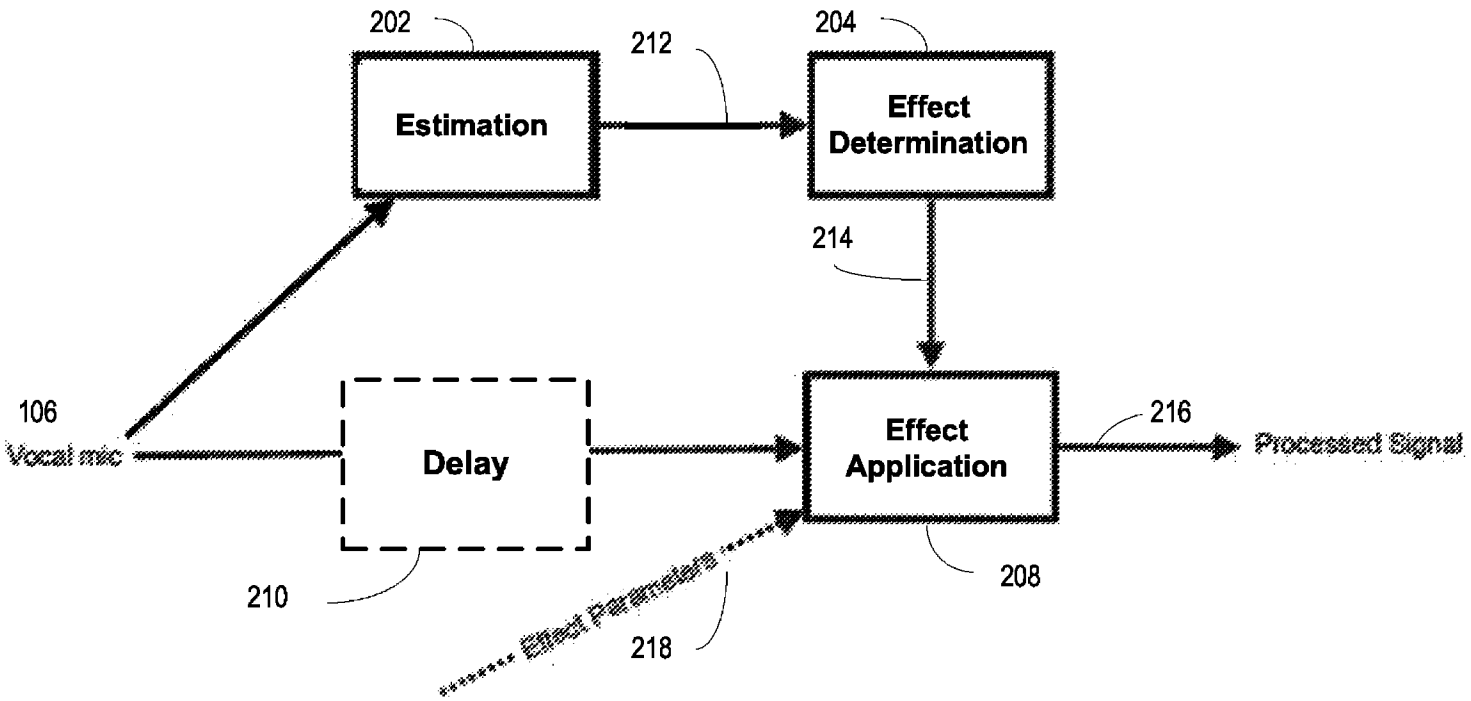
FIG. 2 is a block diagram of an example effect modification module with a vocal microphone input.

FIG. 2 is a block diagram of an example of the effect modification module 122. In FIG. 2, the effect modification module 122 includes an estimation unit 202, an effect determination unit 204, and an effect application unit 208. In some examples, the effect modification module 122 may also include a delay unit 210. In FIG. 2, the input signal to the vocal processing system is a single vocal microphone input received on the vocal microphone input channel 106.

The effect modification module 122 may receive and process the input signal to determine a degree of probability of the input signal containing a vocal signal. The degree of probability, or likelihood of the input signal containing a vocal signal may be based on a vocal likelihood score (VLS). The vocal likelihood score (VLS) of an audio signal is a variable indication of likelihood or probability that an audio signal includes a vocal signal. Determination of the VLS may be performed in many different ways, as described later.

The estimation unit 202, or estimate module, may provide an indication to the effect determination unit 204 of the estimated likelihood or estimated probability of the audio signal including a vocal audio signal on a vocal indication line 212. In one example, the VLS may be provided to the effect determination unit 204 as a variable value between an indication that no vocal signal is present and a vocal signal is present, such as a scale from 0-100. In other examples, predetermined values, representative of the VLS, such as an "includes vocal," "likely includes vocal," "unlikely to include vocal," or "no vocal included" indication, an indication of the signal strength of the vocal audio portion, such as 0% to 100% or any other indicator of whether the audio signal is more or less likely to include a vocal audio signal may be provided.

In general, determination of the likelihood estimate that the audio signal includes a vocal signal using the VLS, may be based on time-based and/or frequency-based analysis of the audio signal, using, for example windowing and fast Fourier transform (FFT) block analysis. For example, a short term energy level of the audio signal may be based on data received during a predetermined period of time forming a data window (such as audio data received in the previous 20 ms to 500 ms) may be compared to a predetermined threshold to identify a VLS value. The higher the energy level of the audio signal is above the predetermined threshold, the higher the likelihood of the presence of a vocal signal is indicated, and the lower below the threshold, the more unlikely the presence of a vocal signal is indicated. In another example, the likelihood estimate can be based on a predetermined threshold ratio between two or more energy estimates from different predetermined frequency bands of the audio signal. In this example, the energy estimates may be an average of an energy level over a predetermined window of time. In addition, the estimation unit 202 may perform matching of the audio signal to a predetermined audio model, such as a vocal tract model. The determination of the likelihood that a vocal signal is included in the input signal may, for example, may be based on estimation of parameters for a model of a vocal tract being matched to predetermined parameters. Estimation of the parameters for the model of the vocal tract can be based on application of the input signal to a model, such as an all-pole model. Upon completion of the estimation, the estimation unit 202 may then decide if the parameters fall within the ranges typically seen in human voices. In still another example, or alternatively, the predetermined frequency bands may be selected based on the estimation unit 202 also dynamically determining if a possible vocal signal included in the audio signal is female or male, for example by comparing the input pitch period and vocal tract model to typical models obtained by analyzing databases of known male and female singers/speakers. A model may, for example, include estimates for formant locations and vocal tract length.

In still other examples, any other method or system for determining the likelihood of an audio signal containing a vocal audio signal may be used to detect the likelihood of presence of a vocal signal in an audio signal. In some cases, it may be advantageous to not only provide a score for the likelihood that the input signal is a vocal audio signal, but also to provide further information about the signal in order to more appropriately control the effect modification module 120. For example, it may be desirable to compute an estimate of the likelihood that input audio source is currently a speaking voice or a singing voice. This can be done by examining the characteristics of the pitch contour. During singing, pitch contours typically show (a) more continuous segments with smooth pitch, (b) fewer unvoiced sounds such as consonants, and (c) a tendency for the pitch to follow notes on a musical scale. This likelihood score can then be used to modify parameters based on the input vocal type as part of the selection of the effect. A typical example is that very often singers want effects to only be active while singing, but not while speaking to the audience between songs. In this case, the effects could be automatically turned off when the likelihood score indicated that the input was most likely a speaking voice.

The effect determination unit 204 may use the vocal indication provided on the vocal indication line 212 to automatically select one or more effects for application to the audio signal. The effects determined by the effect determination unit 204 may be based on a predetermined list of effects selected by a user. Alternatively, or in addition, the effects may be dynamically selected by the system based on the vocal likelihood indication. Thus, determination and/or application of one or more effects by the effect determination unit can be based on a degree of likelihood that the input signal is a vocal audio signal. For example, a first input audio signal with a relatively high degree of likelihood of including a vocal audio signal can have a greater number of effects determined and/or applied, or more aggressive application of effects determined and/or applied than a second input signal with a relatively lower degree of likelihood, even though both are determined to be likely to include a vocal audio signal. Alternatively, or in addition, determination and/or application of one or more effects by the effect determination unit can be based on classification of an input signal determined to have a vocal audio signal, such as classification of the vocal audio signal as being a spoken voice or a singing voice; a male voice or a female voice; or any other classification of the vocal audio signal. Thus, depending on the degree of likelihood of a vocal audio signal being included in the input signal, pre-specified effects may be applied or effects may be automatically and dynamically determined. In addition, depending on the degree of likelihood of a vocal audio signal being included in the input signal, the effects being applied may be correspondingly dynamically adjusted.

In one example, the effect determination unit 204 may receive the VLS. In this example, the effect may be selected and an output effect level of the effect may be dynamically modified based on the VLS received. An example modification process may involve use of a linear mapping between VLS and an output effect level for each respective effect. For example, the linear mapping may be used such that input signals with high probability of being a vocal signal as opposed to background noise have a higher level of a respective effect applied. In other examples using the VLS, more complicated mappings can be used, as well as more sophisticated effect control. For example, instead of simply reducing the output effect level when the VLS drops in magnitude, it may be more advantageous to alter the parameters of the effect as part of the selection process in order to lessen the chance of unpleasant background processing being audible in the output signal. Accordingly, based on the VLS, the level of the effect may be dynamically adjusted, the type of effect applied may be dynamically changed, and/or the parameters of an applied effect may be dynamically adjusted as part of the selection process.

The effect determination unit 204 may provide an effects setting signal on an effect identification (ID) line 214. The effects setting signal may provide an identifier of an effect and corresponding effect parameters associated with the effect. Alternatively, where the effects are predetermined, the effect determination unit 204 may provide the effect parameters as the effects setting signal on the effect ID line 214. The identifier provided on the effects setting signal may provide the effect itself, a predetermined identifier of the effect, or a sequence that triggers use of the effect by the effect application unit 208. The corresponding effect parameters associated with the effect may be settings for the effect, such as a level, that may be used by the effect application unit 208 when the effect is applied.

The effect application unit 208 may apply one or more time varying effects to the audio signal and provide a processed signal output on the processed output signal line 216. Thus, the processed output signal may be the audio signal modified by one or more effects that are added to modify the vocal signal, or vocal signal component, of the audio signal. Application of the effects to the audio signal by the effect application unit 208 may be based on the effect setting signal, and may be varied dynamically as the effect setting signal changes.

Due to the processing of the estimation unit 202 and the effect determination unit 204, the effect application unit 208 may buffer, or otherwise delay the audio signal such that application of the effect is synchronized with the portion of the audio signal being processed. Alternatively, or in addition, the delay unit 210 may provide a predetermined delay, such as, about 10-30 milliseconds of delay to allow for processing of the estimation unit 202 and the effect determination unit 204. In some examples, due to the processing efficiencies of the estimation unit 202 and the effect determination unit 204, the delay may be about 10-15 milliseconds.

The effect application unit 208 may also provide time varying effects, such as a time varying output effect level based on effects parameters provided by other than the effects setting signal on the effects ID line 214, as illustrated by arrow 218. These parameter adjustments may be based on settings or values provided via the user interface, operational parameters, such as the energy level of the audio signal, or external parameters, such as an input signal from a mixing board, energy level of other instruments or voices, or any other parameters capable of affecting the effects.

Effect parameters adjusting a respective effect may be, for example, attenuating an energy level of an output effect being applied to an audio signal, or reducing an amount of an effect being applied to an audio signal. Another example involves adjustment of a doubling effect, which is where a slight echo or reverberation effect is used to allow a person to be perceived as singing with another singer, which is in fact a duplicate of the singers voice slightly delayed or accelerated with respect to the original vocal signal of the singer, which is also provided. Within the doubling effect, doubling effect adjustment may involve how "tight" or "loose" the duplicated vocal signal accompanies the original vocal signal. In other words, the time period of delay between the original vocal signal and the duplicated vocal signal may be adjusted with an effects adjustment. Moreover, effects may be applied to one or both voice signals.

Another effect parameter adjusting a respective effect may be a harmony effect adjustment that advantageously changes the frequency or pitch of a vocal signal, such as by dynamically adjusting a vocal signal up or down an octave to harmonize with another audio source, such as an instrument. Additional effect parameters that may be adjusted for a particular effect may be a volume, a level, panning, or any other parameter capable of adjusting a corresponding effect.

In the situation where the indication of the likelihood of the audio signal including a vocal signal indicates a vocal audio signal is not included, the audio signal may be passed through the effect application unit 208 without modification. Alternatively, or in addition, the effect application unit 208 may ramp, smoothly vary, or otherwise perform time based variation of the effect being applied to the audio signal in response to the estimated likelihood of the audio signal having a change in possible presence of a vocal signal. The time based variation may be over a predetermined period of time and may represent attenuation or an increase in one or more effects. The predetermined period of time of variation of such time-based variations may be different for different effects to avoid or minimize detection by a listener of changes in the effect. Some variations may be substantially instantaneous, whereas other variations may occur at a substantially slower rate of change to avoid detection. The time-based rate at which a particular effect is ramped (increased or decreased) may be dependent on not only the effect, but also the way in which the effect is being adjusted. For example, the amount of the effect, such as an output effect level may be adjusted, which can be more noticeable to a listener if changed abruptly, whereas in other examples, parameters of the effect that change the application of the effect, such as making a reverberation effect less aggressive (decreased) can be less noticeable to a listener and therefore may be changed relatively quickly.

Figure 3:
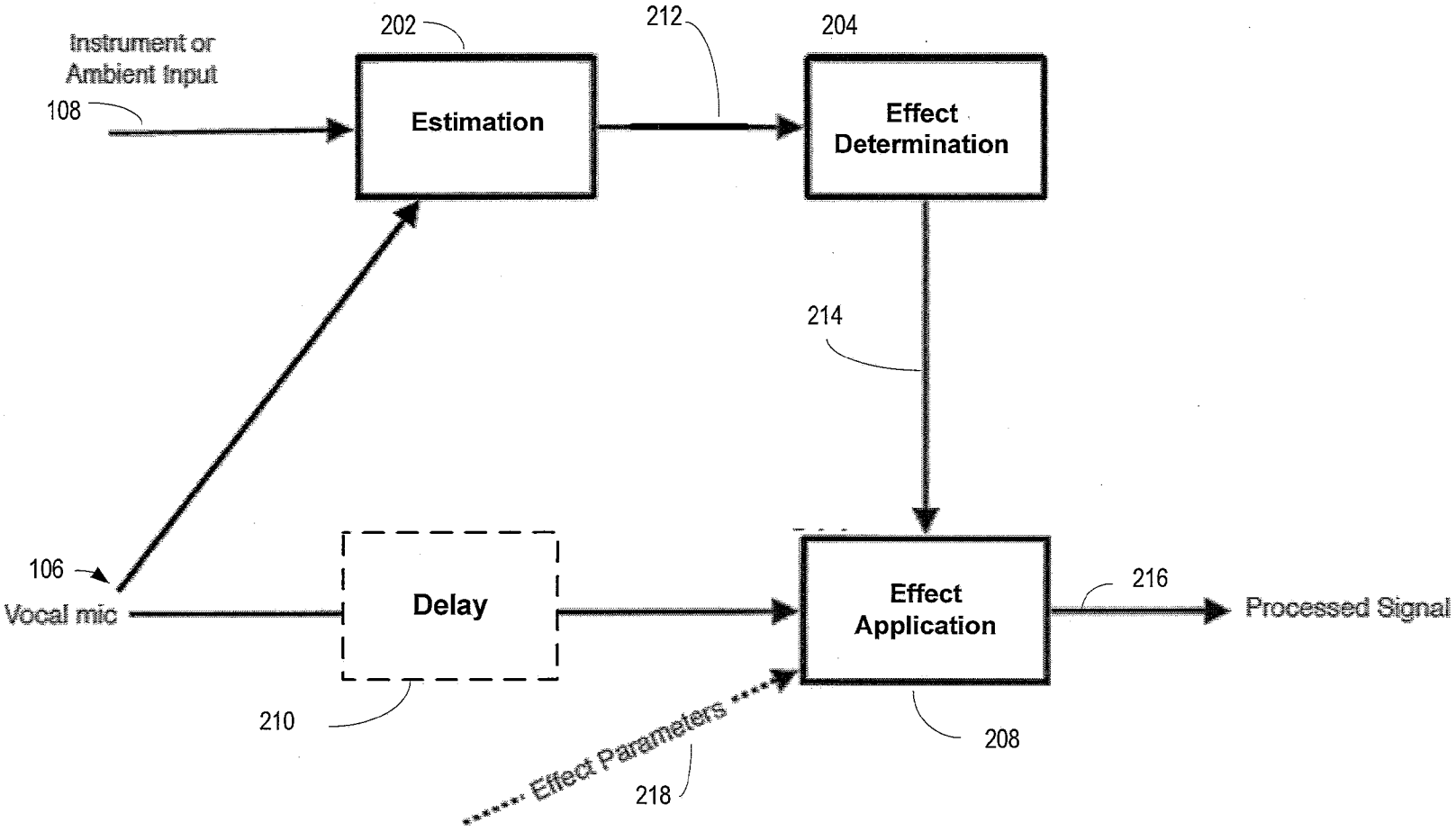
FIG. 3 is a block diagram of an example effect modification module with at least one vocal microphone input and a second non-vocal input.

FIG. 3 is a block diagram of another example of the effect modification module 122. In this example, in addition to the input signal including a vocal microphone input signal channel 106, one or more audio signals on at least one non-vocal input channel 108, such as an instrument signal or ambient noise signal, may be provided. In FIG. 3, the vocal processing system 102 may use the effect modification module 122 to perform vocal likelihood effect control using both the vocal microphone input signal as well as the non-vocal input signal. For purposes of brevity, the following discussion will focus mainly on differences with the previously discussed examples since the previously described capabilities may be present, or may selectively not be present, in this example. In addition to the previous example applications, example applications of the effect modification module of FIG. 3 could be as a vocal harmony processor in which addition of a vocal harmony effect to vocal signals may be determined based on the non-vocal input signal 108.

In FIG. 3, the vocal microphone input signal 106 may be supplied to the estimation unit 202 and the delay unit 210 and/or the effect application unit 208. The non-vocal input(s) 108 may be supplied to the estimation unit 202. The non-vocal input 108, may, for example, be at least one instrument audio signal, such as a guitar signal, or at least one ambient audio signal, such as an area microphone input or background microphone input provided by a microphone spaced away from the microphone providing the vocal microphone input signal on the vocal microphone input channel 106.

The estimation unit 202 of FIG. 3 can use both the vocal microphone input signal and the non-vocal input signal to estimate the likelihood that vocal microphone input signal includes a vocal signal. In the example of a non-vocal signal being a guitar signal, if the main source of non-vocal noise seen at the vocal microphone input channel 106 is the guitar signal (such as the audible sound of an acoustic guitar being picked up by the vocal microphone), the estimation unit 202 may compare the audio signal received on the vocal microphone input channel 106 with the audio signal received from the non-vocal input channel 108. When these signals are highly correlated the estimation unit 202 may identify that the audio signal received on the vocal microphone input line 106 is less likely, or not likely to be a vocal signal (depending on the degree of correlation, for example) using the vocal indication signal provided on the vocal indication line 212. Conversely, when there is little or no correlation between the microphone input signal and the non-vocal signal, the audio signal on the microphone input signal channel 106 may be identified on the vocal microphone input line 106 as likely to include a vocal signal, depending on the degree or level of non-correlation, for example. Correlation of the received audio signals may be an energy magnitude correlation in certain frequency ranges, frequency matching, frequency and energy matching, or any other mechanism or technique for determining similarities between two different audio signals. For example, if an instrument present in the audio signal of the non-vocal input channel is also the dominant signal in the vocal microphone input channel, the estimation unit 202 can identify the audio signal on the vocal microphone input channel as being less likely to be a vocal audio signal. In some examples, it may be advantageous to improve the signal-to-noise ratio at the vocal microphone input channel 106 using the audio signal received at the non-vocal input channel 108, for example, using spectral subtraction techniques.

In some examples, the non-vocal input may be generated with a second microphone designed specifically to pick up background signals. For example, a second microphone may be embedded inside a housing in which the vocal effect processing system 102 is disposed. In this configuration, the second microphone can be used to detect the level of background signal present. This can be used to enhance estimation of vocal likelihood by the estimation unit 202. For example, the estimation unit 202 may compute an RMS or peak signal level of the vocal microphone input signal as well as the non-vocal audio signal of the second microphone. When the vocal microphone input signal energy is much larger than the non-vocal microphone input signal, the estimation unit 202 may indicate that it is likely that a vocal signal is present. However, when the signal at the vocal microphone input signal is similar or lower in energy as compared to a similar audio signal received from the second microphone, the estimation unit 202 may indicate that the vocal microphone input signal is unlikely to be a voice signal. By comparing these energies it is possible to compute a VLS. In one example, the VLS can be obtained by mapping any of the likelihood estimates into a variable range from 0 to 1.

The variability of the VLS may be used in the effect determination unit 204 to selectively determine effects and amount of the effects to be applied based on the confidence level indicated by the VLS, which is described herein as "selection." The more likely that the audio signal includes a vocal signal (such as the higher the VLS) the more effects and/or the more aggressively the effects may be applied. Based on the VLS being provided, the effect determination unit 204 may generate the parameter identification and corresponding parameters as the effects setting signal that is provided to the effects application unit 208. The effects application unit 208 may use the parameter identification and corresponding parameters, as well as effect parameters provided on the effect parameters line 218 to dynamically and selectively apply at least one effect to the audio signal, which is then provided as a processed output signal on the output signal line 216.

Figure 4:
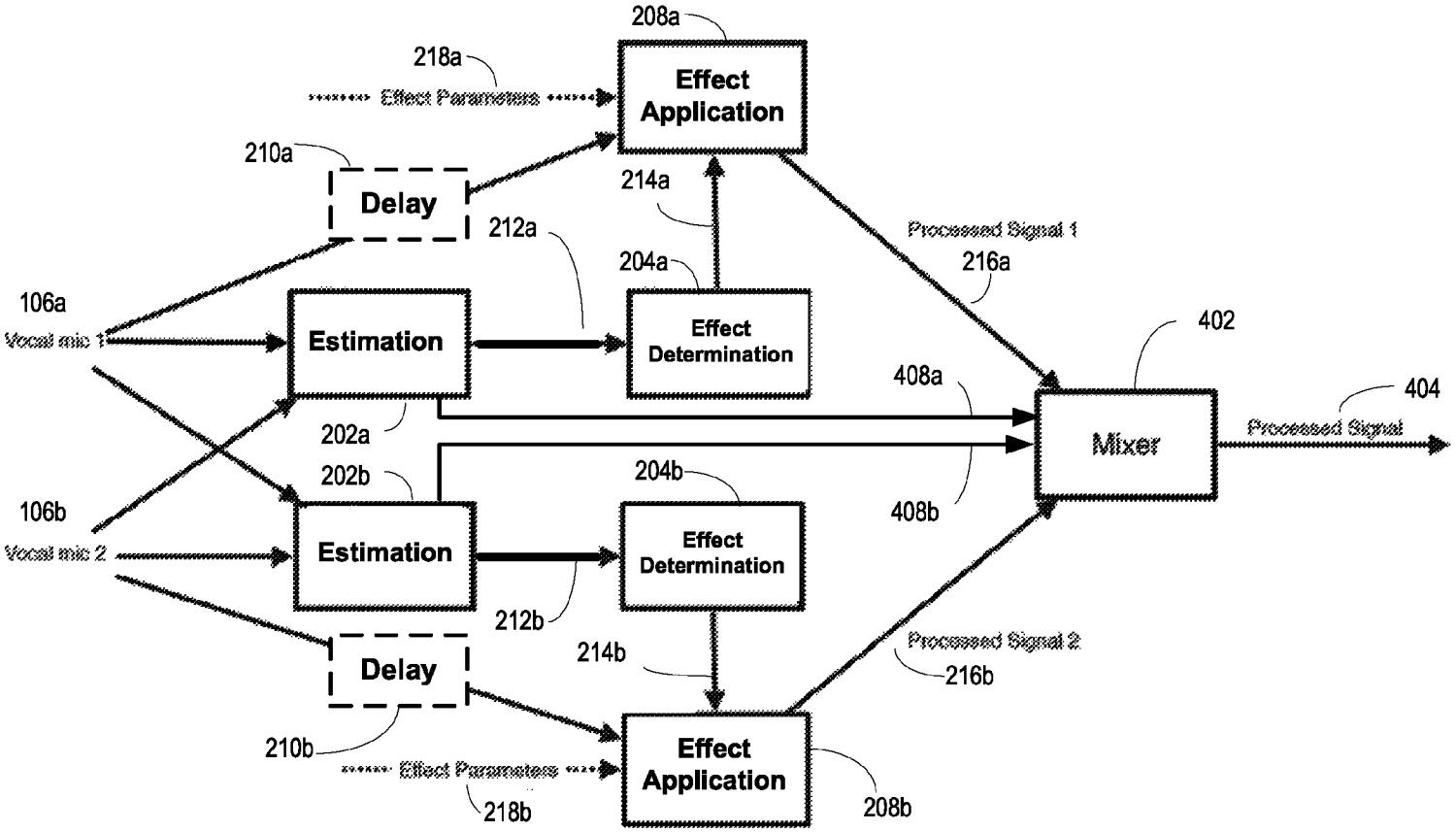
FIG. 4 is a block diagram of an example effect modification module with two or more vocal microphone inputs that can be independently processed.

FIG. 4 is block diagram of another example of the effect modification module 122 that provides vocal likelihood effect control using multiple vocal microphone inputs. In the example system there are two vocal input channels 106, a first vocal microphone input channel 106*a* and a second vocal microphone input channel 106*b*, that can be independently and separately altered using vocal effects processing. In other examples, any number of vocal input channels 106 may be included. For purposes of brevity, the following discussion will focus mainly on the differences with the previously discussed examples of the vocal processing system since the example of FIG. 4 may perform all or some of the capability previously discussed with reference to FIGS. 1-3.

In FIG. 4, the effect modification module 122 may independently determine the VLS score for each vocal microphone input channel 106*a* and 106*b* and selectively and dynamically alter the vocal effect(s) for each vocal microphone input signal separately and independently. Each of a first estimation unit 202*a* and a second estimation unit 202*b* may receive signals from the first and second vocal microphone input channels 106*a* and 106*b*. In a first mode of operation, each of the first estimation unit 202*a* and the second estimation unit 202*b* may calculate VLS using signals on the respective vocal microphone input channels 106*a* and 106*b* to determine if the respective audio signals are more or less likely to be vocal signals as previously discussed.

In a second mode of operation, in addition to the vocal signal likelihood determination of the first mode, the first and second estimation units 202*a* and 202*b* may use signals from both the first and second vocal microphone input channels 106*a* and 106*b* during calculation of VLS. In the second mode, the first and second estimation units 202*a* and 202*b* may also compare the signals on the vocal microphone input channels 106*a* and 106*b* to determine if the vocal microphone input channels 106*a* and 106*b* each contain a separate and independent vocal signal. Thus, if the signals on the vocal microphone input channels 106*a* and 106*b* are similar, the one of the first or second estimation units 202*a* or 202*b* with a higher energy signal on the corresponding vocal microphone input channel 106*a* or 106*b* may identify a higher likelihood of a vocal signal, while the other of the first or second estimation units 202*a* or 202*b* may identify a higher likelihood of background noise with VLS. This technique may be particularly useful when the microphones providing the vocal microphone input channels 106*a* and 106*b* are in close proximity to each other, such as when separated by 10 to 20 centimeters.

In FIG. 4, the first and second estimation units 202*a* or 202*b* may separately and independently output VLS indications on first and second vocal indication lines 212*a* and 212*b*. First and second effect determination units 204*a* and 204*b* may separately and independently determine and output respective selections that may include effects setting signals on respective effects ID lines 214*a* and 214*b*. First and second effect application units 208*a* and 208*b* may receive the output effects and effect parameters (effects setting signals) on respective effects ID lines 214*a* and 214*b*, as well as possibly receiving separate and independent effect parameters on the effect parameters lines 218*a* and 218*b*. The first and second effect application units 208*a* and 208*b* may separately and independently apply effects to the respective audio signals on the first and second vocal microphone channels 106*a* and 106*b*, and output respective first and second processed output audio signals on the output process signal lines 216*a* and 216*b*.

The respective signals on the first and second processed output audio signal lines 216*a* and 216*b* may be provided to a mixer unit 402 that combines the respective processed signals. The mixer unit 402 may output a single processed audio output signal 404 representing the combination of the signals on the respective processed signal lines 216*a* and 216*b*. Thus, a singer using two different microphones at different times during a musical performance may achieve entirely different audio effects simply by singing into one or the other of the two or more microphones. The vocal effect processing system 102 may provide this function since, during operation in the second mode of operation, each of the estimation units 202*a* and 202*b* may independently determine how likely it is that a singer is singing into the corresponding first microphone or the second microphone. As such, the output effect perceived by a listening audience can be changed depending on which microphone the singer is directing vocal sound towards. For example, using this system, a singer could turn a harmony effect on by simply moving from singing in one microphone to singing in another.

In another example, the mixer unit 402 may receive the vocal indications from first and second estimation units 202*a* and 202*b* on effects settings lines 408*a* and 408*b*, and operate as a switch. In this configuration, the mixer unit 402 may provide either the first or the second processed signal 216*a* or 216*b* depending on which of the first and second estimation units 202*a* and 202*b* indicated a higher likelihood of a vocal audio signal. Alternatively, or in addition, the mixer 402 may proportionally mix the processed first and second signals proportionally to the vocal indications.

The previously discussed vocal likelihood score (VLS) can provide a variable measure of how likely it is that a received input signal includes a vocal signal, as opposed to including only background and/or ambient signals such as drums, guitars, room noise, or any other audible sound to which an effect should not be applied. There are many ways of computing the VLS. In one method, the VLS is computed by estimating the short term energy level of the signal input. Because microphone inputs on the vocal effects processing system 102 may be calibrated using the user interface, such as an input gain adjustment knob, it is not unreasonable to assume that the microphone is receiving a vocal signal when the energy of the input audio signal rises above a threshold. In some cases, this threshold can be adjusted from the user interface such that optimal results can be achieved in different environments. For example, the threshold can be set higher when performing in a noisy club as opposed to being used in a quiet studio. By using a threshold range, it is possible to compute VLS. In one example, VLS may be calculated as a value of zero below a lowest threshold, a value of one above a highest threshold, and variably changes along a continuum between the value of zero and the value of one, based on a mapping between the lowest and highest thresholds, such as a linear or logarithmic mapping.

When using only energy to compute the VLS it can be the case that the background noise (such as signals other than the intended input vocal signal) can become quite loud. In this case, the threshold for the energy detection can be set high enough so that effects intended to be applied to the input vocal signal can be disabled or transitioned when the energy of the vocal microphone input signal is low. In other words, the threshold can be set such that the highest energy background noise signal does not overlap with lowest energy intended vocal signal. Where overlap occurs, the vocal effect processing system 102 may use more sophisticated vocal signal detection techniques to detect a vocal signal in the audio signal. In one example, the estimation unit 202 may compute the energy in two or more spectral bands of the audio signal, and then use band ratios (for example high band to low band energy) to identify a vocal signal, as previously discussed.

In other examples, other voice activity classifiers can be based on pitch tracking (such as looking for continuous pitch in the vocal range), vocal tract modeling (how well the input signal fits a typical vocal tract model, as previously discussed), as well as other higher order statistical methods, or any other method for outputting a likelihood estimate based on how well the candidate feature matches the target class. Using predetermined mapping, voice activity classification may be used to determine the VLS.

In some of the previously described examples, there exists multiple microphones that can help improve the quality of the vocal signal detection and estimation by the estimation unit 202. For example, the vocal effect processing system 102 of FIG. 3 includes receipt of at least one non-vocal audio input, such as an input for a guitar, which may be compared, as previously discussed.

Figure 5:
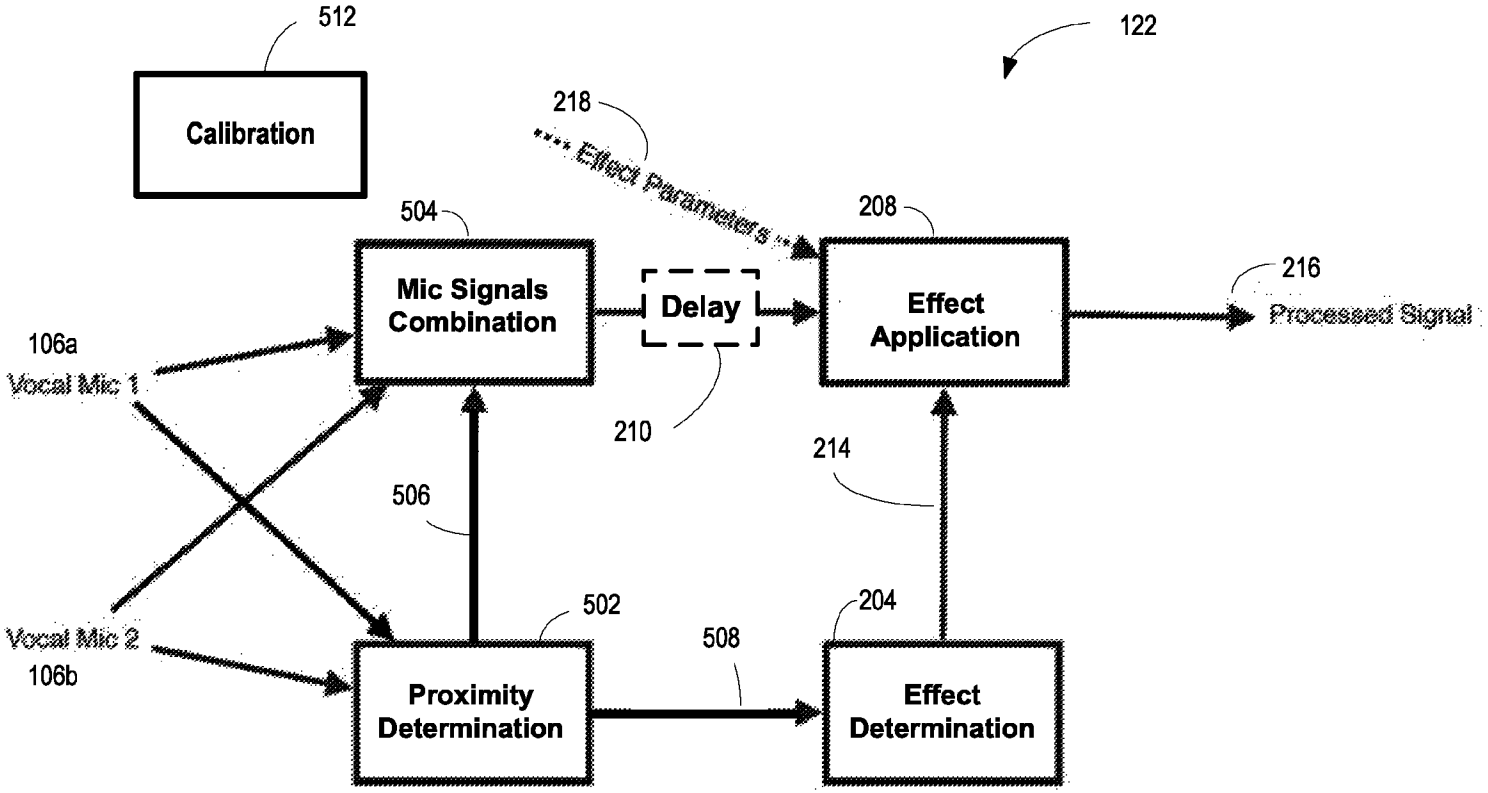
FIG. 5 is a block diagram of an example effect modification module with two or more vocal microphone inputs that may be processed based on a speaker location with respect to the two or more microphones.

FIG. 5 is a block diagram of another example of the effect modification module 122. In FIG. 5, audio signals on multiple vocal microphone input channels may be provided to the effect modification module 122 similar to the system of FIG. 4. In this example, however, a single processing path can be applied. In other examples, a single vocal microphone may be used similar to the previously discussed examples. In addition, the previously discussed functionality may be present in the example of FIG. 5. For purposes of brevity, the following discussion will focus mainly on the differences with the previously discussed examples of the vocal processing system, although the previously discussed examples, or variations thereof, may all be selectively operable in the system. Accordingly, although not illustrated, the effect modification module 122 may include the previously discussed estimation module 202.

In FIG. 5, two vocal microphone input channels (such as 106*a* and 106*b*) are provided to proximity determination unit 502. In addition, or alternatively to the previously discussed examples, the proximity determination unit 502 may include the capability to determine an estimate of which one or more vocal microphones are intended to be activated by a vocalist, such as a singer (the "activation target") based on a proximate location of the vocalist to the vocal microphones. As used herein, the term "proximate" or "proximity" refers to a relational location of one object to another object that is close by in space or time such that a relative corresponding positional relationship can be established. There are many methods for determination of the proximate location of a vocalist with respect to a vocal microphone. For example, proximity sensors may be placed on or near the vocal microphones to detect the proximity of a user to the respective vocal microphones, and the signals received from those proximity sensors can be transmitted to the proximity determination module 502. The proximity sensors can include any mechanism or scheme for detecting relative location of a user, such as temperature, light, magnetic fields, or any other detector of the presence of nearby users. The proximity sensor data can be used to determine the relative distance between the vocalist and the input microphones. The proximity sensors can be any device or mechanism capable of determining distance and relative location, such as photoelectric sensors, inductive sensors, magnetic sensors, light sensors, heat sensors, or any other system or device for determining the presence of a user and relative distance.

Alternatively, or in addition, estimation of the intended activation target based on proximity of a user to a vocal microphone may include an image capturing device as the proximity sensor. The image capturing device, such as a camera, may be positioned at a predetermined location, such as substantially near the center of an input microphone array. Based on the images captured by the image capturing device, proximity of the user with respect to one or more vocal microphones may be used to estimate activation of the vocal microphones, and the respective effects may be varied as previously discussed. For example, the system may perform head pose estimation to estimate the proximity of the user to one or more respective vocal microphones. Based on the head pose estimation, a vocal microphone may be selected as an activation target and effects may be applied and/or adjusted accordingly. Head pose estimation may include determination of a relative proximity or position of a user's face, such as a face angle. Based on the relative proximate location of the user's face with respect to one or more of the vocal microphones, the microphone which the user intended to receive the vocal signal can be estimated and corresponding effects may be applied. In addition, or alternatively, the proximity and corresponding estimation of the activation target(s) may be used to selectively apply or vary effects being added to the audio signals received by one or more of the vocal microphones. As used herein, selection of effects for audio signals includes selection of effects, application of effects to audio signals, and/or modification of effects applied to audio signals.

Alternatively, or in addition, determination of a proximate location of the user with respect to the vocal microphone used to estimate the activation target can involve estimation of a relative location of a user, such as a singer, with respect to one or more of the vocal microphones. An estimation of a relative location of the user can be performed by the system using the input audio signal data in addition to, or instead of the proximity sensor. In some examples, only the input audio signal data from two or more of the vocal microphones can be used to perform the estimation of the relative proximate location. The proximity determination module 502 may compare the content of the at least two audio input signals in order to estimate the distance of the singer relative to each respective microphone (such as microphone 1 and microphone 2). The relative proximate location determination may be used as a measure or estimate of the relative degree to which the user, such as a singer, wants each microphone activated.

Once an estimate of the activation target is determined, the activation target estimate may be provided to a mic signals combination unit 504 on a first activation signal line 506. The mic signals combination unit 504 may combine the two or more inputs in such a way so as to create a single activation-based audio signal. For example, if the estimate of activation indicates the singer desires to activate mic 2, such as due to the singer being closer to mic 2, than mic 1, then the signal from the second vocal microphone channel 106*b* may be predominately used to create the single activation-based audio signal. Creation of the activation-based audio signal may be performed in real-time as the proximate location, and therefore the estimated activation, varies accordingly.

In some examples, the distance between the microphones could be enough that adding the signals from the two different microphones could result in undesirable phase cancellation due to delay differences of the two signals. One example approach to combining the signals by the mic signal combination unit 504, without such phase cancellation, is to cross fade from one vocal input to the other whenever determination of the estimated activation target correspondingly moves from one respective microphone to the other respective microphone. Predictive analysis, such as hysteresis, may be used to avoid rapid cross fading between the vocal inputs when the proximate location and corresponding estimated activation target is determined by the proximity determination unit 502 as being substantially equal between two or more vocal mics, such as when a singer is close to a point that is about half-way between the first and second microphones. In other examples, other approaches can be used in which the delay differences between the two inputs can be calculated, for example using an autocorrelation calculation, and the resulting delay difference can be compensated for before summing the microphone signals. Once the microphone signals are combined by the mic signals combination unit 504, the single activation-based audio signal may be provided to the delay unit 210 and/or the effect application unit 208. In other examples, where only one mic signal is provided, the mic signals combination unit 504 may simply pass the mic signal through to the effect application unit 208 as the activation-based audio signal.

The one or more effects that can be applied can be controlled by the effect parameters provided on the effect parameters line 218, as well the effect settings that may be dynamically determined by the effect determination unit 204 and provided on the effect settings line 214. In FIG. 5, the effect determination unit 204 may determine the effect settings based on the estimated activation target relative to each input microphone, which is provided by the proximity determination unit 502 on a second activation line 508. In an example, the effect parameters on the effect parameters line 218 can be configured to indicate that a vocal doubling effect should be applied when the singer is singing into microphone 1, and a vocal harmony effect should be applied when the singer is singing into microphone 2. The dynamic switching between these two effects can be controlled by the effect determination unit 204 based on proximity and the corresponding activation estimate.

In FIG. 5, an example is shown in which one vocalist uses two microphones placed at close proximity to each other and the vocal effect may be changed by directing his/her voice into one microphone or the other, as previously discussed. The selection of one or more respective effects and the adjustment of the parameters of the respective effects, as previously discussed, may be based on the proximate location of the vocalist and the corresponding estimate of the intended activation target. If one of the two audio signals is provided by a vocal microphone that is estimated to have a substantially higher degree of likelihood of being the activation target, then the effects may be selected and applied accordingly. For example, a level of the effects may be attenuated or the effects may be limited for the audio signal that is provided by the vocal microphone with a lower estimate of being the activation target of the vocalist, such as by being a further proximate distance from the singer. In another example, if both the audio signals are estimated to have a relatively low degree of likelihood of being the intended activation target due to their proximity to the vocalist, the level of the effects of both audio signals may be attenuated, or the respective effects adjusted in accordance with the estimate of the intended activation target.

To obtain an estimate of the activation target, in some examples, the proximity determination unit 502 may perform analysis of the two input signals in order to determine an estimate for the proximity of the vocalist relative to the two microphones. Estimation of the relative distance of the origination of the vocal signals, such as a singer's lips from each of the microphones, may be based on comparison of parameters of the audio signals detected by the respective microphones. Parameters compared may include energy levels, correlation, delay, volume, phase, or any other parameter that is variable with distance from a microphone.

An example for determining an estimate of intended activation based on a relative proximate location of a singer or speaker with respect to the microphones can involve using energy differences between the two signals. For example, an energy ratio of short term energy estimates between the two microphones can be computed in order to estimate an approximate proximity of the singer, such as a relative distance of the singer, from each of the microphones. If both microphones have substantially the same gain, sensitivity, and pattern, for example, the ratio of the two energies can be approximately 1.0 when the singer is directing vocal energy to the halfway point between the two microphones and the relative distance to each of the microphones is approximately equal. Predetermined parameters, a table, or calculations may be performed to estimate the proximate location or relative distance based on the energy differences. In this example, the effects can be applied and adjusted for both audio signals.

In another example, correlation of the different vocal microphone input signals from the different microphones may be used to determine a proximate location and a corresponding estimate of the intended activation, such as by estimation of location and relative distances from the microphones to the singer. In addition, or alternatively, determination of the amount of delay among the different vocal microphone input signals may be used to determine an estimate of the intended activation based on a relative position of the microphones with respect to the proximate location of the singer.

Calibration may also be performed in order to estimate the relative energy receiving patterns for the two microphones. The calibration may be completed with a calibration module 512 included in the in the effect modifications module 122, or elsewhere in the vocal effects processing system. Calibration may be performed with the calibration module 512 using a manual process in which test tones are generated by the vocal processing unit. Alternatively, or in addition, the user can be prompted to sing or otherwise provide vocal audio into each microphone in turn. Alternatively or additionally, calibration may be performed automatically in real time by the calibration module 512. The calibration module 512 may detect situations in which there is no vocal signal being input to either microphone (using the techniques previously discussed with respect to the estimation unit 202), and then computing the ratio of energies between the two microphones. One method for auto-calibration is to determine a dynamic threshold that represents our running estimate of the signal level difference between the two microphones when no vocal input is intended in the vocal microphone. Then, when the level difference rises above this threshold, it is assumed that the vocal microphone has an active vocal signal. The dynamic threshold can be determined by estimating the minimum and maximum envelopes of the energy difference signal between the two microphones using envelope following. A smoothed signal floor estimate is then computed by filtering the difference signal with a low pass filter, but only using samples as input to this filter that occur when the difference is below a threshold with respect to the maximum and minimum of the estimated envelopes. For example, if we only use difference signal values in our energy floor estimate when the difference signal is lower than, for example, half the range from our minimum estimate to our maximum estimate, we are ensuring that our estimate is not being affected by situations where there is obviously a strong active vocal signal on the vocal microphone. This smoothed signal floor estimate can then be used as the basis of the dynamic voice threshold.

Thus, in addition to using the previously discussed vocal likelihood score (VLS), to apply effects to vocal signals, the vocal effects processing system may also use proximity of a vocalist to a vocal microphone as a parameter in application of effects. Use of proximity may be based on some form or proximity detection, or based on processing of multiple audio signals from multiple respective vocal microphones to determine proximity. Either VLS or proximity, or a combination of VLS and proximity may be used by the vocal effects processing system to determine, select, modify and/or apply effects to audio signals.

Figure 6:
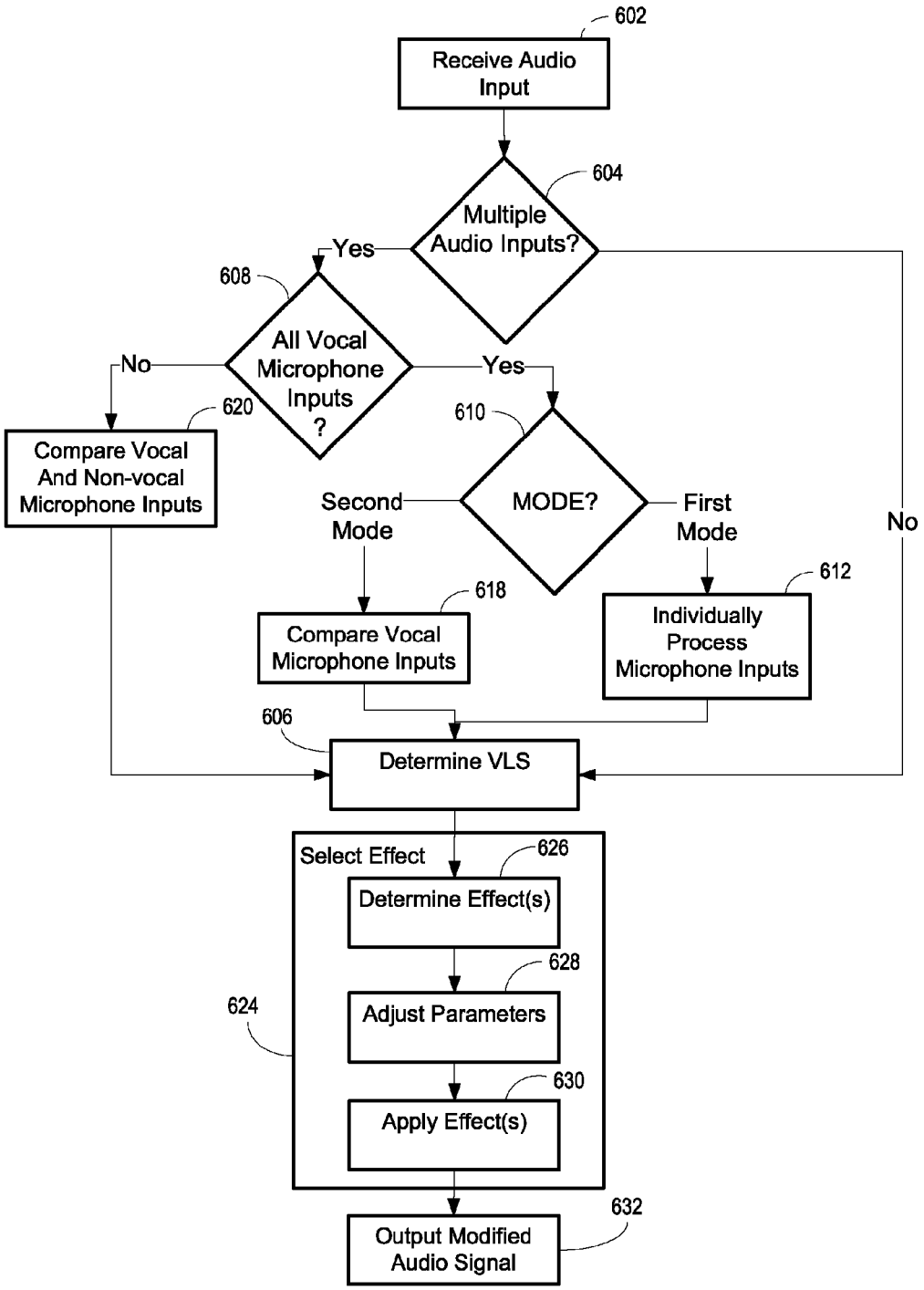
FIG. 6 is an example operational flow diagram of the vocal effect processing system.

FIG. 6 is an operational flow diagram of an example vocal effect processing system discussed with regard to FIGS. 2-4. The operation begins at block 602, when one or more audio signals are received by the system. At block 604, it is determined if there is more than one audio signal received. If there is one audio signal at block 604, an estimate of the degree of likelihood or probability that the audio signal includes a vocal signal, such as a VLS, is determined at block 606, such as based on a short term energy estimate, a ratio of energy estimates, modeling, or any other way to obtain a probability of a vocal signal.

If at block 604 it is determined that there is more than one audio input signal, it is determined if all the audio inputs are from vocal microphones at block 608. If all the audio inputs are from vocal microphones, it is determined at block 610 which mode the system performs. If the system performs a first mode, at block 612 the system individually processes each of the microphone input signals. At block 606 the system performs an estimate based on individual analysis of the different audio signals to determine an estimate of the degree of likelihood, such as a VLS, for each audio signal. If at block 610 the system performs a second mode, at block 618 the system performs comparisons among the different audio signals from the vocal microphones. At block 606, the system determines the degree of likelihood of each of the audio inputs including a vocal signal, such as VLS. The comparison may for example relate to short term energy estimates, correlation, or estimation of a relative location of the source of audible sound, such as a singer's voice, included in the audio input.

If at block 608, it is determined that at least some of the audio inputs are from vocal microphones and at least some of the audio inputs are from non-vocal microphones, the system compares the vocal and non-vocal microphone inputs at block 620. At block 606, the system performs an estimate of the degree of likelihood based on at least one audio input signal from a vocal microphone, and at least one audio input signal from a non-vocal microphone, such as by comparison or correlation.

At block 624, one or more effects are selected based on respective degrees of likelihood of vocal signals being included in the respective audio signals (VLS), which may involve determining at least one effect (block 626), and/or adjusting parameters of at least one effect (block 628), and at block 630, the one or more effects are applied to the corresponding audio signals for which the effects were selected. The operation continues at block 632 where the audio signals, which may be modified by one or more effects may be output as modified audio output signals.

Figure 7:
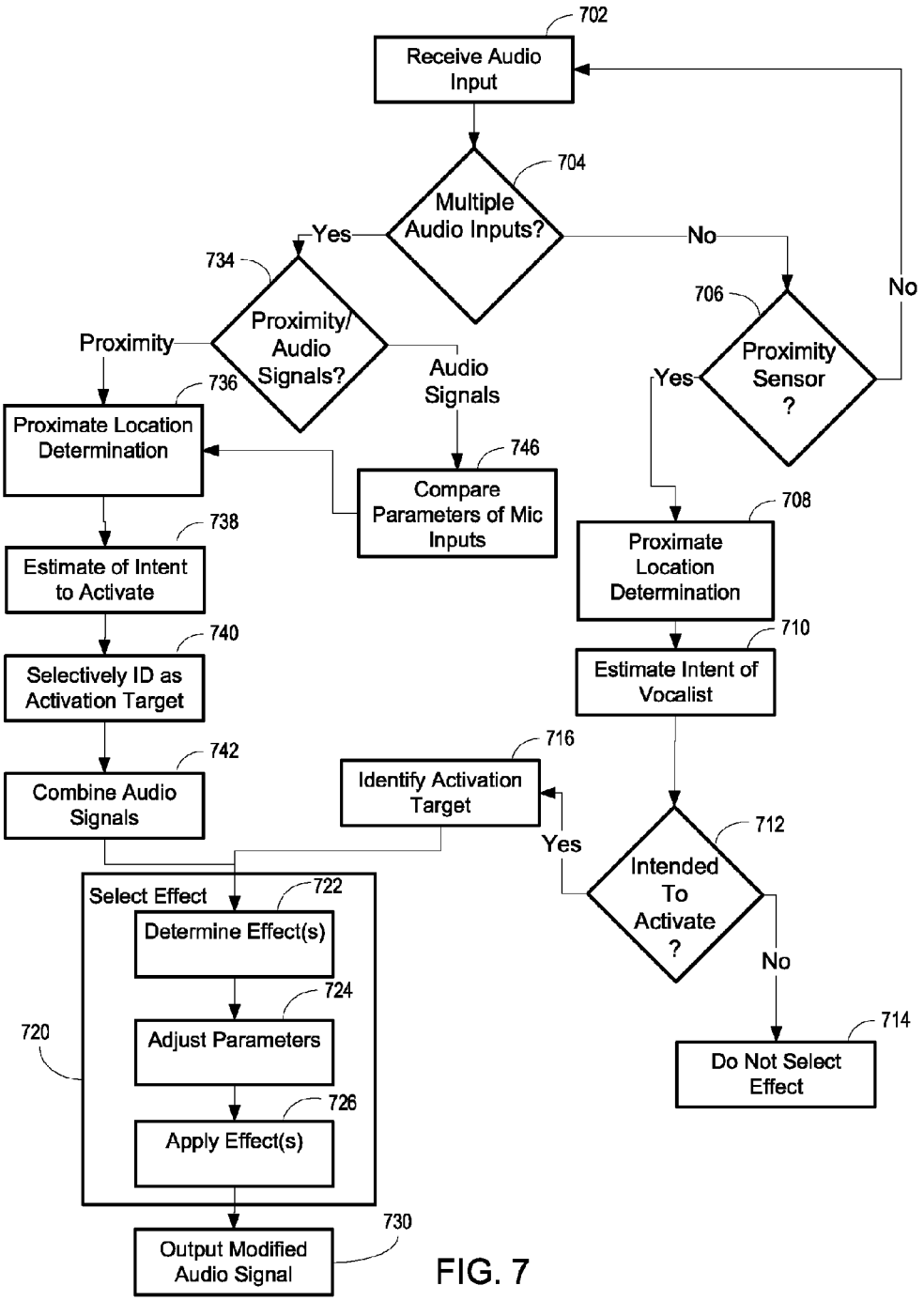
FIG. 7 is another example operational flow diagram of the vocal effect processing system.

FIG. 7 is another operational flow diagram illustrating example operation of vocal effect processing system discussed with regard to FIG. 5. The operation begins at block 702, when one or more audio signals that include vocal signals are received by the system from one or more respective vocal microphones. At block 704, it is determined if there is more than one audio signal received. If there is one audio signal at block 706, it is determined if a proximity signal is available, such as an image capture, or any other indication of a proximate location of a source of the vocal signal. If not, the operation returns to block 702 to receive audio input signals.

If at block 706 a proximity sensor is available, the system determines a proximate location of the source of the vocal signal based on an input signal from the proximity sensor at block 708. At block 710, the system estimates an intent of a vocalist to activate the vocal microphone as a function of the proximate location. It is determined if the estimate indicates that the vocalist intended to activate the vocal microphone at block 712. If the estimate indicates that the vocalist did not intend to activate the vocal microphone, at block 714, no effect is selected. If the estimate indicates that the vocalist did intend to activate the vocal microphone, the microphone input is identified as an activation target at block 716.

At block 720, the audio signal becomes the activation-based audio signal (since there are no other audio signals to combine with), and one or more effects are selected based on the proximate location and corresponding estimate of the intent of the user. Selection of effects may involve determining one or more effects (block 722), and/or adjusting parameters of an effect (block 724). At block 726, the one or more effects are applied to the corresponding audio signals for which the effects were selected. The operation continues at block 730 where the audio signals, which have been modified by one or more effects may be output as modified audio output signals.

Returning to block 704, if there are multiple audio signals provided by multiple respective vocal microphones, at block 734 it is determined if the operation will use a proximity sensor, or multiple of the audio signals to estimate a proximate location of the source of the audio signal. If a proximity sensor is used, at block 736 an estimate of the proximate location of the vocalist is determined. At block 738, an estimate of the intent of the vocalist to activate each of the multiple vocal microphones is determined based on the proximate location. The vocal microphones are selectively identified as activation targets at block 740 based on the proximate location. At block 742, the audio signals are combined to form the activation-based audio signal. The operation than proceeds to block 720 to select one or more effects, and output a modified audio signal at block 730, as previously discussed.

Returning to block 734, if the audio signals are used to estimate a proximate location of the vocalist with respect to the audio microphones, at block 746 parameters of at least two of the audio signals detected by respective vocal microphones are compared to develop the estimated proximate location. Parameters compared may include energy levels, correlation, delay, volume, phase, or any other parameter that is variable with distance from a microphone, as previously discussed. The operation then proceeds to blocks 736-742 to estimate a proximate location, estimate a vocalists intent to activate a respective vocal microphone, selectively identify activation targets, and combine audio signals as previously discussed. In addition, the operation selects effects and outputs a modified output signal at blocks 720 and 730, as previously discussed.

To clarify the use in the pending claims and to hereby provide notice to the public, the phrases "at least one of <A>, <B>, . . . and <N>" or "at least one of <A>, <B>, . . . <N>, or combinations thereof" are defined by the Applicant in the broadest sense, superseding any other implied definitions herebefore or hereinafter unless expressly asserted by the Applicant to the contrary, to mean one or more elements selected from the group comprising A, B, . . . and N, that is to say, any combination of one or more of the elements A, B, . . . or N including any one element alone or in combination with one or more of the other elements which may also include, in combination, additional elements not listed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A vocal effect processing system comprising:

a processor;

an input signal processing module executable by the processor to receive an audio signal from a vocal microphone, the audio signal representative of a vocal signal detected by the vocal microphone; and an effect modification module executable by the processor to estimate a proximate location of a source of the vocal signal with respect to the vocal microphone, the effect modification module further configured to apply an effect to the audio signal in accordance with the estimated proximate location of the source of the vocal signal, wherein the audio signal is a plurality of audio signals received from a plurality of microphones, wherein a first audio signal of the plurality of audio signals is indicative of a first vocal signal that is received from a first microphone of the plurality of microphones and a second audio signal of the plurality of audio signals is indicative of a second vocal signal that is received from a second microphone of the plurality of microphones, and wherein the effect modification module is executable by the processor to employ predictive analysis to avoid cross fading between the first vocal signal and the second vocal signal when at least an estimated activation target is determined as being positioned at a location that is equal between the first microphone and the second microphone.

2. The vocal effect processing system of claim 1, where estimation of the proximate location of the source of the vocal signal is based on analysis of the audio signal.

3. The vocal effect processing system of claim 1, where estimation of the proximate location of the source of the vocal signal comprises estimation of a distance between the vocal microphone and the source of the vocal signal based on a signal received from a proximity sensor.

4. The vocal effect processing system of claim 1, where application of the effect to the audio signal by the effect modification module in accordance with the estimated proximate location of the source of the vocal signal comprises modification of the effect based on the estimated proximate location.

5. The vocal effect processing system of claim 1, wherein the effect modification module is executable by the processor to employ the predictive analysis via hysteresis to avoid cross fading between the first vocal signal and the second vocal signal when at least an estimated activation target is determined as being equal between the first microphone and the second microphone.

6. A vocal effect processing system comprising:

a processor;

a proximity determination module executable by the processor to receive from a vocal microphone an audio signal representing a vocal signal generated by a sound source;

the proximity determination module further executable by the processor to estimate a proximate location of the sound source with respect to the vocal microphone;

an effect determination module executable by the processor to determine an effect for application to the audio signal based on the estimated proximate location of the sound source with respect to the vocal microphone; and an effect application module executable by the processor to apply the determined effect to the audio signal;

where the vocal microphone is a plurality of vocal microphones, and the audio signal is a respective plurality of audio signals, and where the proximity determination module is executable by the processor to estimate the proximate location of the sound source relative to at least two vocal microphones based on respective audio signals from the at least two vocal microphones, and a mic signals combination module executable by the processor to combine the respective audio signals from the at least two vocal microphones in accordance with the estimate of the proximate location to form an activation-based audio signal, where the proximity determination module is further executable by the processor to employ predictive analysis to avoid cross fading between the respective audio signals when at least an estimated activation target is determined as being positioned at a location that is equal between the at least two vocal microphones.

7. The vocal effect processing system of claim 6, where the mic signals combination module is further executable by the processor to combine the respective audio signals by selection of one of the respective audio signals having a largest short term energy estimate as being a predominant portion of the activation-based audio signal.

8. The vocal effect processing system of claim 6, where the mic signals combination module is further executable by the processor to cross fade from a first one of the respective audio signals to a second one of the respective audio signals as a level of short term energy of the respective audio signals varies.

9. The vocal effect processing system of claim 6, where the mic signals combination module is further executable by the processor to adjust a delay of the respective audio signals prior to combination of the respective audio signals.

10. The vocal effect processing system of claim 6, where the proximity determination module is further executable by the processor to estimate the proximate location of the sound source based on comparison of energy estimates of the respective audio signals from the at least two vocal microphones.

11. The vocal effect processing system of claim 6, where the proximity determination module is further executable by the processor to estimate the proximate location of the sound source based on correlation of the respective audio signals from the at least two vocal microphones.

12. The vocal effect processing system of claim 6, where the proximity determination module is further executable by the processor to estimate the proximate location of the sound source based on a determination of delay between the respective audio signals from the at least two vocal microphones.

13. The vocal effect processing system of claim 6, where the effect application module is executable by the processor to at least one of attenuate and reduce an amount of the effect.

14. The vocal effect processing system of claim 6, further comprising a calibration module, the calibration module executable by the processor to detect absence of vocal signals in the respective audio signals and to compute a ratio of energies between at least two vocal microphones included among the vocal microphones.

15. The vocal effect processing system of claim 6 wherein the effect modification module is executable by the processor to employ predictive analysis via hysteresis to avoid cross fading between the respective audio signals when at least an estimated activation target is determined as being positioned at a location that is equal between the at least two vocal microphones.

16. A non-transitory computer readable memory storage device having instructions stored thereon that are executable by a processor to provide vocal effect processing, the computer readable storage device comprising:

instructions executable by the processor to receive respective audio signals from each of a plurality of vocal microphones, the respective audio signals representative of audible sound detected by each of the vocal microphones;

instructions executable by the processor to estimate an intent of a user to activate one or more of the vocal microphones to receive vocal audio generated by the user;

instructions executable by the processor to identify at least one of the vocal microphones as an activation target based on the estimate of the intent of the user to activate the one or more of the vocal microphones;

instructions executable by the processor to apply a vocal doubling effect to a respective first audio signal of a first microphone of the at least one of the vocal microphones when the first microphone is identified as the activation target; and instructions executable by the processor to apply a vocal harmony effect to a second audio signal of a second microphone of the at least one of the vocal microphones when the second microphone is identified as the activation target.

17. The computer readable storage device of claim 16, further comprising instructions by the processor to receive an input signal from a proximity sensor that is indicative of a proximate location of the user with respect to the vocal microphones, the estimate of the intent of the user to activate one or more of the vocal microphones determined based on the input signal.

18. The computer readable storage device of claim 16, further comprising instructions by the processor to estimate a proximate location of the user with respect to the vocal microphones based on the respective audio signals, the estimate of the intent of the user to activate one or more of the vocal microphones determined based on the estimated proximate location.

19. The computer readable storage device of claim 18, where the instructions executable by the processor to estimate a proximate location of the user comprises instructions executable to correlate the respective audio signals.

20. The computer readable storage device of claim 16, further comprising instructions executable by the processor to combine the respective audio signals as a function of the estimate of the intent of the user to generate an activation-based audio signal.

21. The computer readable storage device of claim 20, further comprising instructions executable by the processor to combine the respective audio signals as a function of estimate of the intent of the user to generate an activation-based audio signal.

22. The computer readable storage device of claim 16, further comprising instructions executable by the processor to adjust for an estimated relative delay of the vocal microphone audio signals prior to combination.

* * * * *